US008381705B2

(12) United States Patent
Kuentzle et al.

(10) Patent No.: US 8,381,705 B2
(45) Date of Patent: Feb. 26, 2013

(54) METHOD FOR CHECKING THE OPERATIONAL CAPABILITY OF A FUEL TANK VENTILATION VALVE

(75) Inventors: Matthias Kuentzle, Schwieberdingen (DE); Uwe Neumann, Stuttgart (DE); Achim Jung, Ditzingen (DE); Andreas Pape, Oherriexingen (DE)

(73) Assignee: Robert Bosch GmbH, Stuttgart (DE)

( * ) Notice: Subject to any disclaimer, the term of this patent is extended or adjusted under 35 U.S.C. 154(b) by 392 days.

(21) Appl. No.: 12/771,182

(22) Filed: Apr. 30, 2010

(65) Prior Publication Data

US 2010/0305828 A1 Dec. 2, 2010

(30) Foreign Application Priority Data

Apr. 30, 2009 (DE) ..... 10 2009 002 746

(51) Int. Cl.
*F02M 33/04* (2006.01)
*F02M 33/02* (2006.01)

(52) U.S. Cl. ..... 123/519; 123/198 D

(58) Field of Classification Search ..... 123/519, 123/518, 516, 520, 698, 198 D; 137/43, 137/493, 587, 588, 589; 73/114.39, 40.7; 701/102

See application file for complete search history.

(56) References Cited

U.S. PATENT DOCUMENTS

| | | | | |
|---|---|---|---|---|
| 5,780,728 | A * | 7/1998 | Takamori | 73/114.39 |
| 6,886,397 | B2 | 5/2005 | Esteghlal et al. | |
| 2004/0040537 | A1 * | 3/2004 | Esteghlal et al. | 123/339.11 |
| 2005/0050949 | A1 * | 3/2005 | Esteghlal et al. | 73/118.1 |

FOREIGN PATENT DOCUMENTS

| | | |
|---|---|---|
| DE | 1000 43 071 | 3/2002 |

* cited by examiner

*Primary Examiner* — Mahmoud Gimie
(74) *Attorney, Agent, or Firm* — Merchant & Gould P.C.

(57) ABSTRACT

A method for checking the operational capability of a fuel tank ventilation valve (7) of a fuel tank ventilation system of a motor vehicle with an internal combustion engine (1) having an intake manifold pressure-based detection of filling levels is thereby characterized in that the fuel tank ventilation valve (7) is selectively activated to open or close and in correlation to this the operational capability of the fuel tank ventilation valve (7) is suggested from the thereby resulting intake manifold pressure ($p_s$).

5 Claims, 1 Drawing Sheet

METHOD FOR CHECKING THE OPERATIONAL CAPABILITY OF A FUEL TANK VENTILATION VALVE

This application claims benefit of Serial No. 10 2009 002 746.7, filed 30 Apr. 2009 in Germany and which application is incorporated herein by reference. To the extent appropriate, a claim of priority is made to the above disclosed application.

BACKGROUND

The invention relates to a method for checking the operational capability of a fuel tank ventilation valve of a motor vehicle with an internal combustion engine having an intake manifold pressure-based detection of filling levels.

A computer program and a computer program product, which are suitable for carrying out the method, are the subject matter of the present invention.

Present day internal combustion engines have fuel tank ventilation systems, wherein fuel evaporating in the tank is stored in an activated charcoal filter, which is connected to the intake manifold of the internal combustion engine via a blockable fuel tank ventilation valve. When the fuel tank ventilation valve is open, air is drawn in via a connection of the activated charcoal filter to the atmosphere. This intake air carries the intermediately stored fuel along and supplies it for combustion. The gas quantity drawn in is controlled by the fuel tank ventilation valve such that on the one hand the activated charcoal filter is sufficiently flushed with air and on the other hand no intolerably large disturbances of the air/fuel ratio of the mixture supplied to the internal combustion engine occur.

For the sake of complying with government regulations, a defective fuel tank ventilation valve installed in a fuel tank ventilation system must now be recognized as defective by suitable diagnoses. It is already known how to open a fuel tank ventilation valve during the operation of the engine and how to evaluate a reaction from an air/fuel ratio control loop for diagnostic purposes. The fuel vapor mixed with air from the fuel tank ventilation (regeneration gas) causes a disturbance in the control loop so that the occurrence of the disturbance indicates an operable fuel tank ventilation and thereby in particular an operable fuel tank ventilation valve. This is, for example, described in the German patent application DE 100 43 071 A1.

Provision can thereby be made for the fuel tank ventilation valve to repeatedly open and for a statistical evaluation of the change in mixture, which arises by controlling the valve to open and is detected by means of a lambda probe, to be used for diagnostic purposes. This test can be carried out at idle or when the engine is partially loaded. In so doing, the fuel tank ventilation valve is slowly controlled to open in a ramp-like manner without having the total system take this controlled opening into account. In other words, the air/fuel fraction, which is supplied to the engine via the fuel tank ventilation valve, is not taken into account when said fuel tank ventilation valve is being controlled to open. An intact, respectively defective, fuel tank ventilation valve can be suggested by means of the reaction of the total system to this disturbance variable, which now occurs and represents a deviation in the mixture. If now, however, it is the case that the mass flow directed across the fuel tank ventilation valve does not contain any hydrocarbon molecules, i.e. when "flushing" an unloaded activated charcoal filter, a reaction of the lambda control does not thereby result after opening the fuel tank ventilation valve, and therefore it cannot be determined whether a defective fuel tank ventilation valve is present. In other words, the case can occur that the fuel tank ventilation valve is in fact properly controlled to open; however, a deviation in the mixture is not determined so that—as previously mentioned—a conclusion regarding the operational capability of the fuel tank ventilation valve cannot be made.

The detection of filling levels results for example with the aid of a hot film air-mass meter. Detections of filling levels are also known using an intake manifold pressure sensor. In this kind of detection of filling levels, the gas additionally introduced into the system and thus into the intake manifold is directly measured using an intake manifold pressure sensor.

SUMMARY

In contrast it is very advantageously possible to detect an opening of the fuel tank ventilation valve in an intake manifold pressure-based system. For this purpose, the fuel tank ventilation valve is opened and/or closed, and the operational capability of the fuel tank ventilation valve is suggested from the intake manifold pressure which thereby occurs. As a result of this, a correlation can be directly analyzed between the opening of the fuel tank ventilation valve and the intake manifold pressure which thereby occurs.

As a result of the measures cited in the dependent claims, advantageous modifications and improvements to the method stated in the independent claim are possible. It is thus preferred to open and again close the fuel tank ventilation valve quickly in pulsed manner. It is particularly advantageous that no detectable influence on the driving behavior of the motor vehicle is caused by this short-term, abrupt opening and closing of the fuel tank ventilation valve. Furthermore, the diagnosis of the fuel tank ventilation valve can be carried out in much shorter time than is the case in the methods known from the technical field. Legal requirements that diagnoses must be performed within certain timeframes can thereby be reliably met.

According to a preferred embodiment of the method, the temporal behavior of the intake manifold pressure is simultaneously acquired with the pulsed opening and closing activation of the fuel tank ventilation valve, and an operable fuel tank ventilation valve is then suggested if the intake manifold pressure essentially changes by a predetermined value synchronously with the opening and closing activation of the fuel tank ventilation valve. The predetermined value is selected such that a reliable opening and closing of the fuel tank ventilation valve can be detected. The value can, for example, be empirically determined.

In principle different times are possible with regard to the opening and closing times of the fuel tank ventilation valve. It is particularly advantageous for the opening and closing activation of the fuel tank ventilation valve to take place within a fraction of a second.

BRIEF DESCRIPTION OF THE DRAWINGS

Examples of embodiment and configurations of the invention are depicted in the drawings and are explained in detail in the following description.

The following are schematically shown.

DETAILED DESCRIPTION

Figure 1:
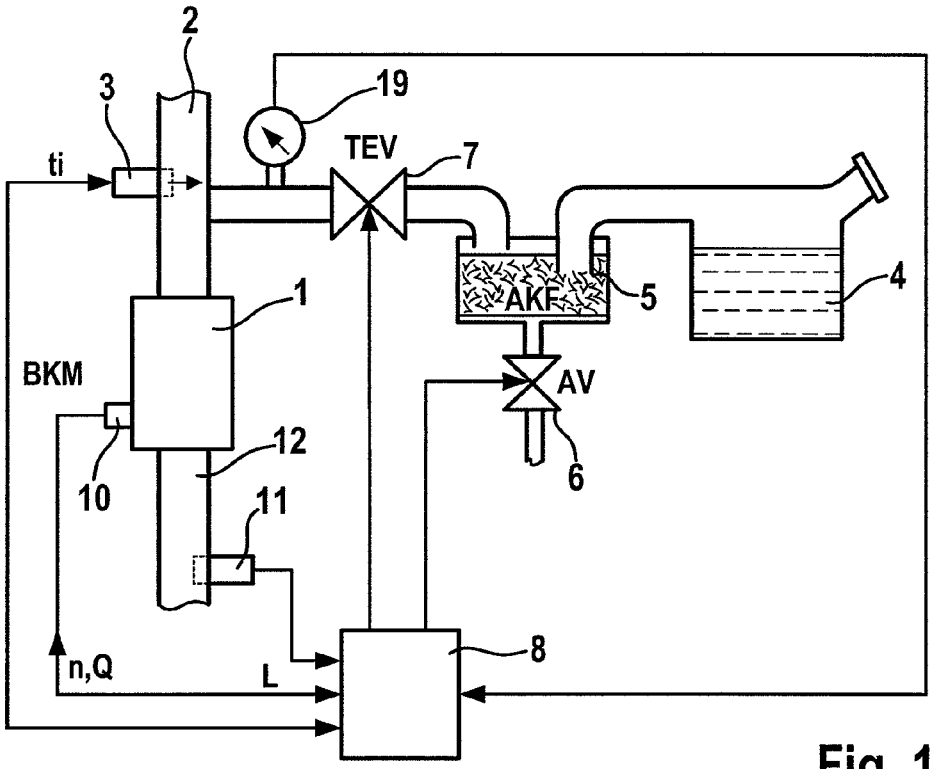
FIG. 1 is a fuel tank ventilation system suitable for carrying out the method according to the invention and FIG. 2 is the temporal course of the opening/closing activation of the fuel tank ventilation valve plotted versus the intake manifold pressure which thereby occurs.

In FIG. 1 an internal combustion engine (BKM) 1 is depicted, which is supplied with air via an intake manifold 2 and fuel out of a tank 4 via a fuel metering means 3. In order to prevent fuel vapors from escaping out of the tank 4 into the atmosphere, a tank ventilation system is provided, which comprises an activated charcoal filter (AKF) 5 and a fuel tank ventilation valve (TEV) 7 disposed in the line between the activated charcoal filter 5 and the intake manifold 2. An activatable check valve AV6 disposed in a ventilation line allows for the activated charcoal filter 5 to be sealed off, whereby fuel vapors are prevented from escaping into the atmosphere. Fuel evaporating in the tank 4 is stored in the activated charcoal filter 5 and is supplied for combustion via the intake manifold 2 during the operation of the internal combustion engine when the fuel tank ventilation valve 7 and the check valve 6 are open. At the same time the activated charcoal filter 5 is flushed with fresh air due to the resulting pressure ratios. A control unit 8 serves to control the tank ventilation via the opening and closing of the aforementioned valves. A pressure sensor 19, which acquires the intake manifold pressure, is disposed downstream of the fuel tank ventilation valve 7 in the intake manifold 2 or in a line leading to said intake manifold 2. The signal from this pressure sensor 19, which is subsequently referred to as the intake manifold pressure sensor, is supplied to the control unit 8. Moreover, variables characterizing the combustion process, as for example the injection time ti, the engine rotational speed n, the injected fuel quantity Q as well as the load L, are supplied to the control unit 8 by corresponding sensor means 10. Furthermore the control unit 8 is provided with the air/fuel ratio lambda, which is acquired by a lambda sensor 11 in a manner known per se, which is disposed in the exhaust gas tract 12 of the internal combustion engine 1.

Figure 2:
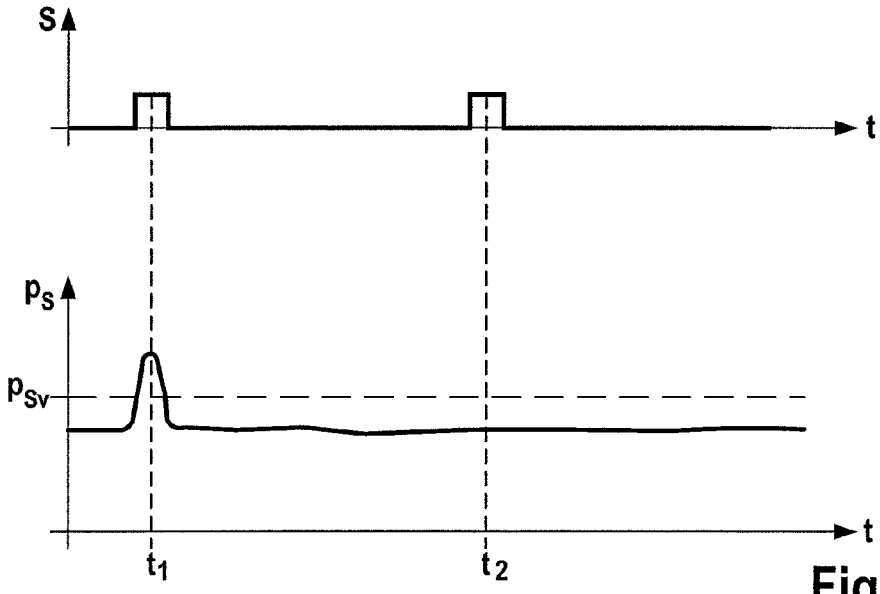

On the basis of legal provisions and regulations, it is now required to check the operational capability of the fuel tank ventilation valve 7 within certain cycles. This takes place with the aid of the method described below in connection with FIG. 2.

In order to check the operational capability of the fuel tank ventilation valve 7, said valve is activated by the control unit 8 to open and close in pulsed manner. The activation signal S is schematically depicted in the upper portion of FIG. 2. The intake manifold pressure $p_s$ is plotted versus time in the lower graph. At a first point in time t1, the fuel tank ventilation valve is momentarily, preferably within the fraction of a second, activated to open and close. The intake manifold pressure $p_s$ is acquired by means of the intake manifold pressure sensor 19. The acquisition of the intake manifold pressure $p_s$ occurs at least when the fuel tank ventilation valve 7 is being activated to open and close. If the intake manifold pressure $p_s$ significantly changes when the fuel tank ventilation valve 7 is being activated to open and exceeds a predeterminable intake manifold pressure threshold $p_{sv}$ and immediately again drops to an original value after the fuel tank ventilation valve 7 has been activated to close, an intact fuel tank ventilation valve 7 is assumed. If on the other hand no change occurs synchronously with the fuel tank ventilation valve being activated to open and close, as is depicted using a second time $t_2$, a fuel tank ventilation valve 7, which is not intact, i.e. defective (sticking open or closed), must be assumed.

A check of the operational capability of the fuel tank ventilation valve 7 can even then be conducted with the method, which basically examines a correlation between the abrupt activation of the fuel tank ventilation valve 7 to open or close and the intake manifold pressure $p_s$ which occurs in the process and allows for a conclusion to be drawn herefrom whether the fuel tank ventilation valve is intact, if when opening the fuel tank ventilation valve 7 no hydrocarbons are flushed out of the activated charcoal filter 5, which lead to a significant change in the mixture. Such a change in the mixture is used in the technical field for checking the operational capability of the fuel tank ventilation valve 7. This check fails if a loading of the activated charcoal filter is not present and also to the extent that a change in the mixture does not occur when said fuel tank ventilation valve 7 is properly opened. As a result of the previously described method, a check of the operational capability of the fuel tank ventilation valve 7 is on the other hand also possible when "flushing" an unloaded activated charcoal filter 5 by detecting a correlation between the activation of the fuel tank ventilation valve 7 to open or close and the intake manifold pressure.

The method described above can, for example, be implemented as a computer program on a computer, in particular in a control unit 8 of the internal combustion engine 1, and be run thereupon. The program code can be stored on a machine-readable carrier, which the control unit 8 can read. In so doing, the existing method can be advantageously used for existing fuel tank ventilation systems by means of software upgrades.

The invention claimed is:

1. Method for checking the operational capability of a fuel tank ventilation valve of a fuel tank ventilation system of a motor vehicle with an internal combustion engine having an intake manifold pressure-based detection of filling levels, comprising selectively activating the fuel tank ventilation valve to open and close in a pulsed manner;

simultaneously acquiring the temporal behavior of the intake manifold pressure ($p_s$); and correlating the temporal behavior of the intake manifold pressure ($p_s$) to the opening and closing of the fuel tank ventilation valve;

wherein an operable fuel tank ventilation valve is suggested if the intake manifold pressure ($p_s$) essentially changes synchronously by a predeterminable value with the opening and closing of the fuel tank ventilation valve.

2. Method according to claim 1, wherein the fuel tank ventilation valve is initially activated to open and immediately thereafter to close.

3. Method according to claim 1, wherein the activation of the fuel tank ventilation valve to open and close occurs within a fraction of a second.

4. Computer program encoded on a tangible computer-readable medium, which carries out all of the steps of a method according to claim 1, when it is run on a computer, in particular in a control unit of the internal combustion engine.

5. Computer program product with program code, which is stored on a machine-readable carrier, for carrying out the method according to claim 1, when the program is executed on a computer or in a control unit of an internal combustion engine of a motor vehicle.

* * * * *